US005177548A

United States Patent [19]

Nakamura et al.

[11] Patent Number: 5,177,548

[45] Date of Patent: Jan. 5, 1993

[54] IMAGE RECORDING APPARATUS WITH PROVISION FOR BLANK BINDING SPACE

[75] Inventors: Shinichi Nakamura, Kawasaki; Tomobumi Nakayama, Tokyo; Hisatsugu Tahara, Kawasaki; Satoshi Kuroyanagi, Tokyo; Osamu Iwamoto, Kawasaki, all of Japan

[73] Assignee: Canon Kabushiki Kaisha, Tokyo, Japan

[21] Appl. No.: 608,831

[22] Filed: Nov. 5, 1990

[30] Foreign Application Priority Data

Nov. 9, 1989 [JP] Japan ..... 1-290105
Nov. 9, 1989 [JP] Japan ..... 1-290106

[51] Int. Cl.[5] ..... G03G 21/00

[52] U.S. Cl. ..... 355/324; 270/53; 355/311; 412/37

[58] Field of Search ..... 355/309, 209, 324, 321, 355/243, 325, 311, 218, 319; 270/53, 37; 412/37

[56] References Cited

U.S. PATENT DOCUMENTS 4,444,491 4/1984 Rinehart et al. ..... 270/53 X
4,626,156 12/1986 Baughman et al. ..... 355/324 X
4,647,188 3/1987 Komiya et al. ..... 355/55
4,712,908 12/1987 Nakayama et al. ..... 355/243
4,825,250 4/1989 Miyata et al. ..... 355/14
4,831,411 5/1989 Sugishima ..... 355/319
4,963,931 10/1990 de Jong et al. ..... 355/218

FOREIGN PATENT DOCUMENTS 62-11874 1/1987 Japan ..... 355/311
62-185676 8/1987 Japan ..... 355/325
62-186279 8/1987 Japan ..... 355/324
62-257179 11/1987 Japan ..... 355/324
1-104564 4/1989 Japan ..... 270/53
1-117172 5/1989 Japan ..... 355/324
1-189662 7/1989 Japan .

*Primary Examiner*—A. T. Grimley
*Assistant Examiner*—Shuk Y. Lee

[57] ABSTRACT

An image recording apparatus includes an input key for inputting a binding mode for binding a plurality of recording sheets; an image forming until for forming an image on the recording sheet, the image forming unit forming the image while providing a predetermined blank space when the binding mode is inputted from the input key; and a binding unit for binding a plurality of recording sheets ejected out from the image forming unit by adding a predetermined cover sheet when the binding mode is inputted from the input key.

14 Claims, 13 Drawing Sheets

FIG. 8

| DATA CONTENTS | |
|---|---|
| 1 | 601 BIND MODE FLAG |
| 0 | 602 MANUAL BIND MODE FLAG |
| 0 | 603 GROUP MODE FLAG |
| 0 | 604 SORT MODE FLAG |
| 0 | 605 NORMAL MODE FLAG |
| 5 | 606 NUMBER OF ORIGINALS |
| 001 | 607 SIZE OF ORIGINAL |
| 2 | 608 NUMBER OF COPIES |
| 500 | 609 THICKNESS DATA |
| 001 | 610 COVER SHEET DATA |
| 1 | 611 LEFT BIND MODE FLAG |
| 0 | 612 SINGLE BIND MODE FLAG |
| 0 | 619 START FLAG |
| — | 618 COVER SHEET SET |
| — | 613 EMPTY FLAG |
| — | 614 END FLAG |
| 000000001 | 615 COVER SHEET SIZE AND THICKNESS CODE OF UPPER STAGE |
| 000001001 | 616 COVER SHEET SIZE AND THICKNESS CODE OF MIDDLE STAGE |
| 000010001 | 617 COVER SHEET SIZE AND THICKNESS CODE OF LOWER STAGE |
| | |

IMAGE RECORDING APPARATUS WITH PROVISION FOR BLANK BINDING SPACE

BACKGROUND OF THE INVENTION

1. Field of the Invention

The present invention relates to an image recording apparatus capable of forming an image on a recording sheet while providing a blank binding space on it.

2. Related Background Art

As an after-processing apparatus of an image recording apparatus such as a copy machine, there are known a binding mechanism and the like for binding recorded transfer sheets by staples. It is necessary to manually cover printed matters to be bound with a cover sheet and manually insert them in such a general binding mechanism. An image recording apparatus has been proposed which sets the size of a binding blank used for binding transfer sheets in accordance with an instruction by an operator.

With a conventional image recording apparatus of this type, it is necessary for an operator to manually set the position and size of a binding blank. Moreover, the set binding blank size has not always an optimum binding margin.

SUMMARY OF THE INVENTION

It is an object of the present invention to provide an improved image recording apparatus eliminating the above-described disadvantages.

It is another object of the present invention to provide an image recording apparatus having an improved operation of copying and automatically binding a plurality of originals.

It is a further object of the present invention to provide an image recording apparatus capable of giving neat appearance of images by changing the binding blank size in accordance with the number of sheets to be bound.

It is a still further object of the present invention to provide an image recording apparatus capable of giving near appearance of images by changing a copy magnification factor in accordance with the number of sheets to be bound.

It is another object of the present invention to provide an image recording apparatus having an improved operation and reducing input operations by an operator by using the sheet number data of originals as a parameter for determining a binding blank size.

The other objects of the present invention will become apparent from the following description and claims when read in connection with the accompanying drawings.

BRIEF DESCRIPTION OF THE DRAWINGS

FIGS. 7A, 7A-1, 7A-2 and 7B are flow charts showing the processes to be executed by the copy machine; and FIG. 8 illustrates the type of information transferred from the copy machine to the binding machine.

DETAILED DESCRIPTION OF THE PREFERRED EMBODIMENT

An embodiment of this invention will be described with reference to the accompanying drawings.

Figure 1:
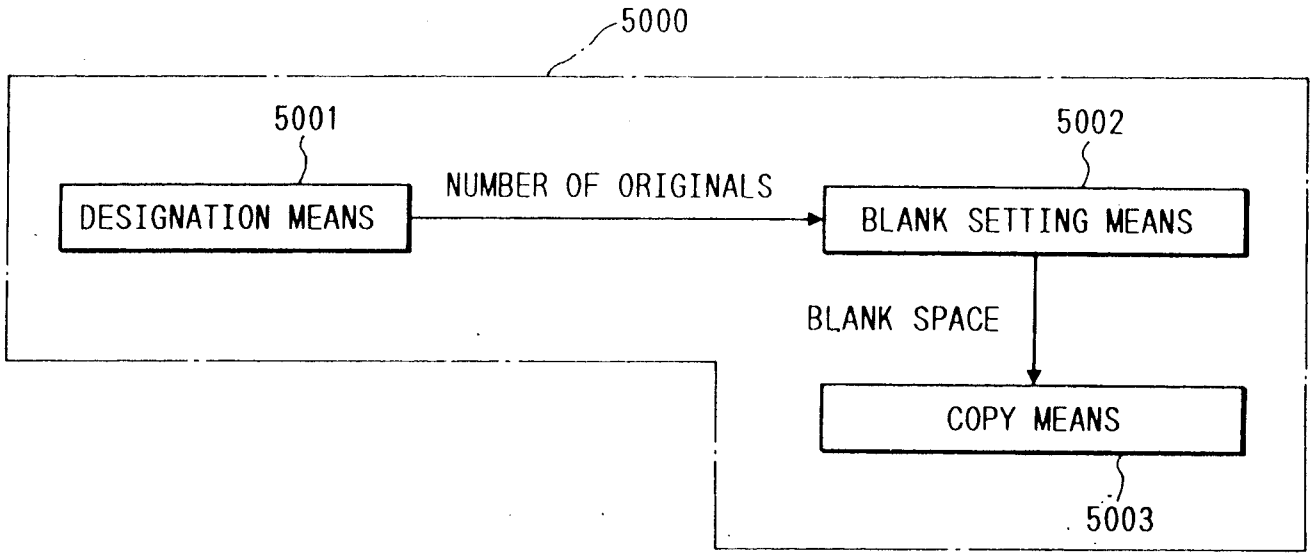
FIG. 1 is a block diagram showing a fundamental circuit arrangement of an embodiment of this invention.

FIG. 1 shows the fundamental circuit arrangement of an embodiment of this invention.

In FIG. 1, an image recording apparatus 5000 copies a plurality of original images onto transfer sheets while providing binding blank spaces.

Designation means 5001 designates the number of originals.

Blank setting means 5002 sets the blank space having a predetermined size corresponding to the number of originals.

The image recording apparatus 5000 has copy means 5003 which copies an image of an original by shifting the position thereof so as to obtain the blank space set by blank setting means. A blank is formed by changing the original exposure timing, sheet feeding timing, and resist roller driving timing. Copy means 5003 copies an image of an original at a suitable scale so as to form the blank space set by blank setting means.

Figure 2:
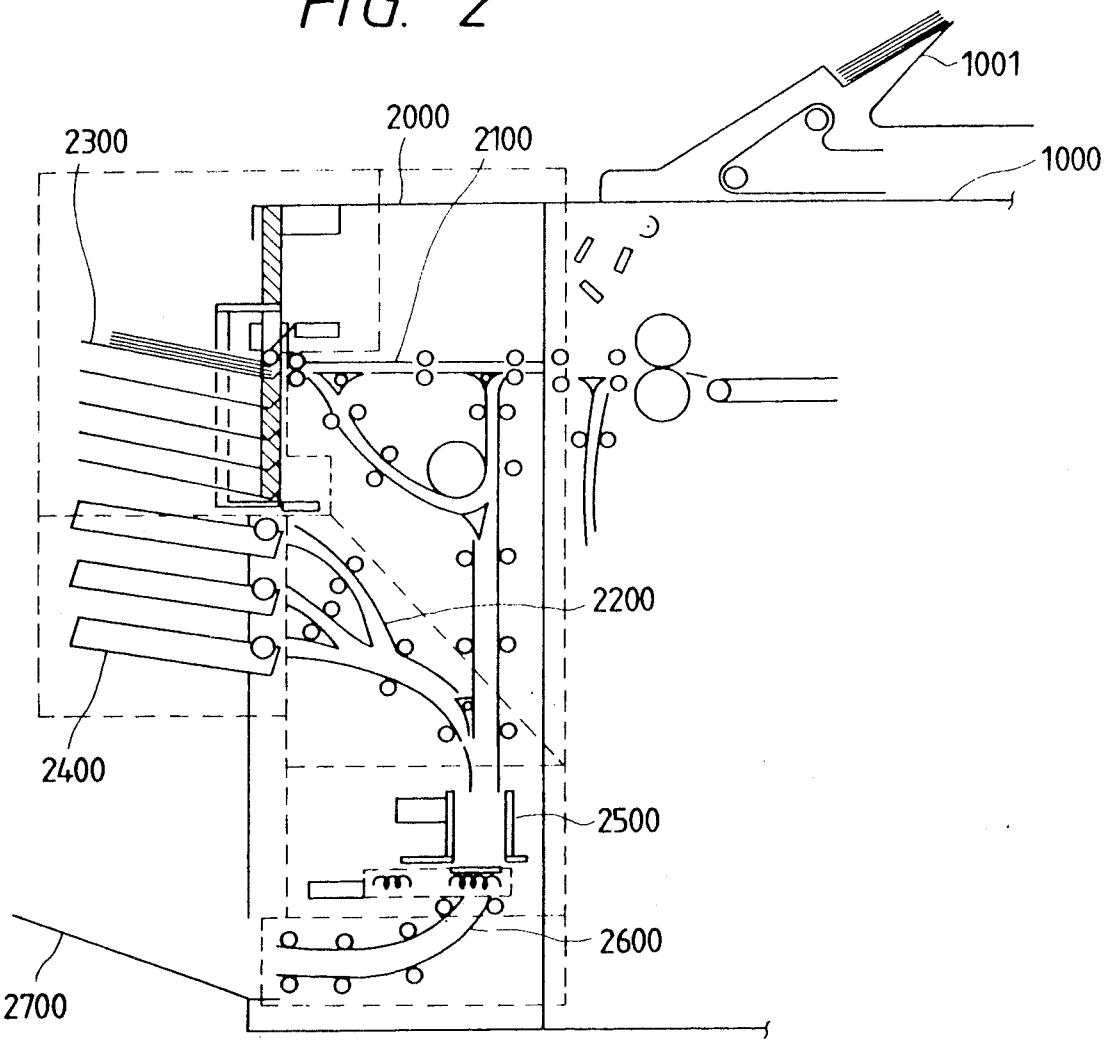
FIG. 2 is a cross sectional view showing the structure of the main part of the embodiment of this invention.

FIG. 2 shows the fundamental structure of the embodiment of this invention.

In FIG. 2, a copy machine 1000 copies a plurality of original images onto transfer sheets while providing binding blank spaces. In this embodiment, as the copy machine 1000 a laser printer is used which exposes a laser beam to a photosensitive drum to form a latent image. An original processing apparatus 1001 is coupled to the copy machine 1000. The original processing device 1001 feeds an original to the image reading stage of the copy machine 1000 in synchronization with the copy operation of the copy machine 1000. A first feed unit 2100 of a binding mechanism (device) 2000 feeds a transfer sheet sent from the copy machine 1000. A second feed unit 2200 feeds a cover sheet from a cover sheet cassette 2400 to a binding unit 2500. A tray 2400 is used dedicatedly for temporarily storing a transfer sheet. The cover sheet cassette 2400 stores a cover sheet. The binding unit 2500 binds the cover sheet and transfer sheets with adhesive agent. A cooling unit 2600 cools the hot adhered cover sheet. A binding tray 2700 stores bound transfer sheets.

Figure 3:
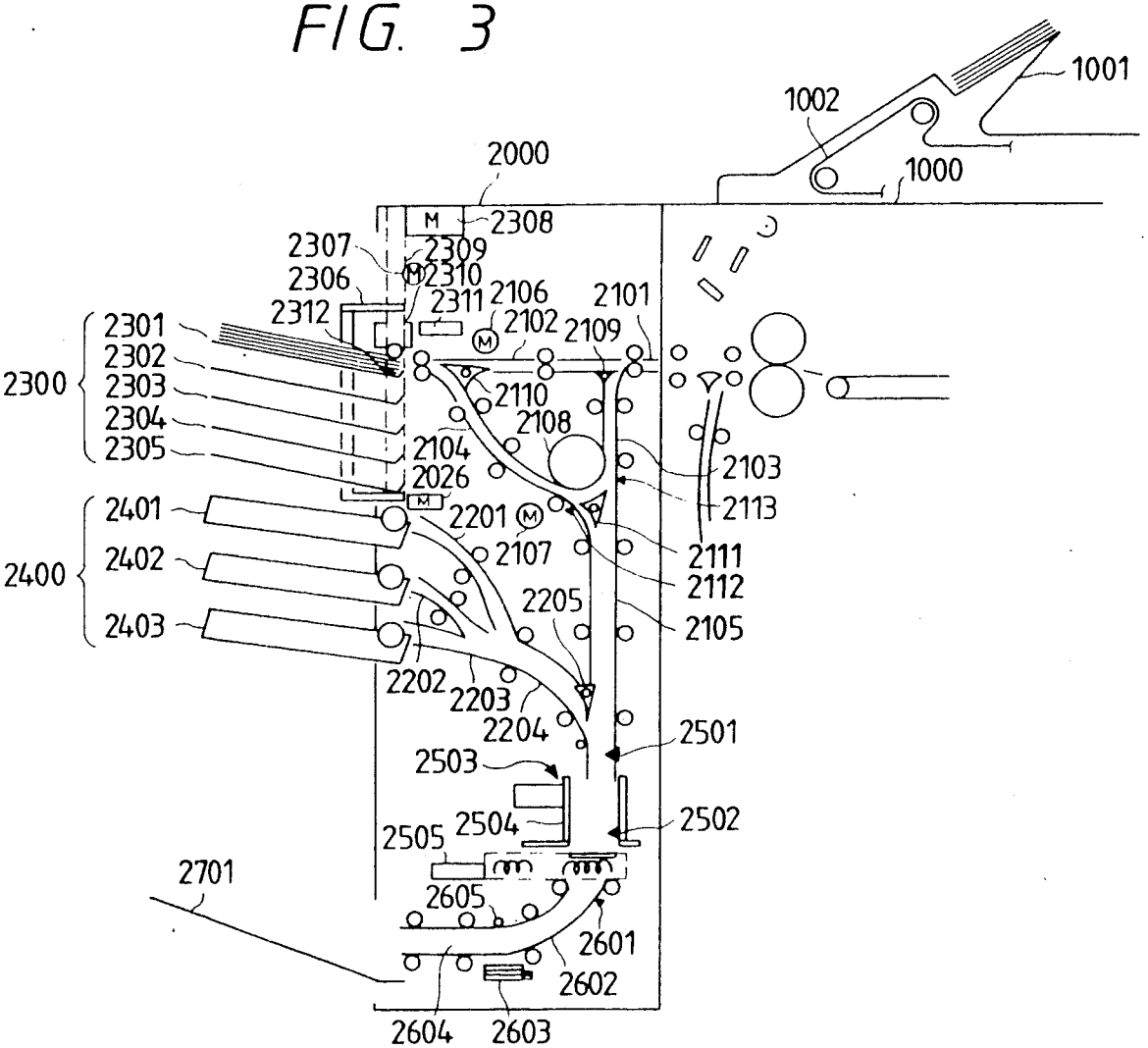
FIG. 3 is a cross sectional view showing the detailed structure of the main part of the embodiment of this invention.

FIG. 3 shows the detailed structure of the units within the binding device 2000 shown in FIG. 2.

In FIG. 3, the original processing device 1001 has a feed path 1002 for feeding an original. A flapper 2109 of the binding device 2000 selects as the recorded transfer sheet feed path either a feed path 2102 or a feed path 2103. The flapper 2109 is usually set to the feed path 2102 to advance a transfer sheet to the feed path 2102. Rollers mounted on the feed paths 2101 and 2102 are driven by a first feed motor 2106 at the feed speed same as that of the copy machine 2102.

A flapper 2110 selects either a path to temporary storage bins 2301 to 2305 or a path to a feed path 2104. In FIG. 3, the flapper 2110 is set so as to select a path to the temporary storage bins 2301 to 2305, so that a transfer sheet ejected out of the copy machine 1000 is fed to the temporary storage bins.

A re-feeding roller 2311 again feeds a bundle of transfer sheets stored in any one of the temporary storage bins to the binding device. While a transfer sheet is fed to the temporary storage bin, the refeeding roller 2311 is retracted above the temporary storage bin. When a first copied transfer sheet of a second bundle is fed, the temporary storage bin 2302 is shifted up by a lead cam 2309 and motor 2308, and set at the downstream outlet of the feed path 2102.

When a second copied transfer sheet of a first bundle is fed, the temporary storage bin 2301 is shifted down by the reverse rotation of the lead cam 2309, and set at the downstream outlet of the feed path 2102. If two bundles of five originals are copied, the lead cam 2309 is shifted by the rotation of the motor so that five transfer sheets for the first bundle are ejected out to the temporary storage bin 2301, and five transfer sheets for the second bundle are ejected out to the bin 2302. There is provided a swing rod 2306 to align the edges of transfer sheets of each bundle such that the swing rod 2306 is moved by a driving motor 2307 to contact the transfer sheets.

A bundle of five transfer sheets with their edges aligned is stapled by a stapler 2310 which is retracted from the temporary storage bin while it is not used. The stapled transfer sheet bundle is sent to the feed path 2104 by the re-feeding roller 2311.

Cover sheet cassettes 2401 to 2403 are detachably mounted on the binding device 2000. Each cover sheet cassette stores a cover sheet of a different size.

In this embodiment, each cover sheet cassette stores a cover sheet having a size corresponding to an A4 size after binding. The cassette 2401 stores a cover sheet for a bundle of 1 to 5 transfer sheets, the cassette 2402 stores a cover sheet for a bundle of 6 to 10 transfer sheets, and the cassette 2403 stores a cover sheet for a bundle of 11 to 20 transfer sheets.

Feed paths 2201 to 2203 for feeding cover sheets from the cover sheet cassettes 2401 to 2403 join together at the upstream of a feed path 2204 to feed a cover sheet to a binding unit 2503 by means of feed rollers.

The feed rollers mounted on the feed paths 2201 to 2203 are independently driven by a driving motor to select a cover sheet suitable for the number of transfer sheets of a bundle.

The driving motor 2107 also drives independently other rollers mounted on the feed paths 2103 to 2105, 2602 and 2604 by means of transmission mechanisms (not shown).

When a cover sheet setting detection sensor 2502 mounted within the binding unit 2503 detects that a cover sheet was fed within the binding unit 2503, a heater of a heating unit 2505 is heated so that an adhesive agent on the back of a cover sheet is melted by means of a copper plate (not shown).

When the cover sheet setting detection sensor 2502 detects an arrival of a cover sheet, the re-feeding roller 2311 is driven to make a re-feeding path flapper 2110 turn to the feed path 2104 side. Therefore, the stapled transfer sheet bundle is fed to the binding unit 2503 via the feed path 2104 and feed path 2105. A flapper 2111 mounted at a junction of the feed paths 2103 and 2104 operates to guide a transfer sheet bundle from the feed path 2103 to the binding unit 2503.

One side 2504 of the binding unit 2503 is movable and set at the position spaced from the other side by the amount slightly longer than the thickness of a transfer sheet bundle.

A transfer sheet bundle and a cover sheet set at the binding unit 2503 are adhered together by melted adhesive agent. After the heating unit 2505 is retracted, the bound bundle is fed to the feed path 2602. A fan 2603 is mounted near the feed path 2604 to cool the bundle transported from the feed path 2602 to 2604 lower than a predetermined temperature to cure tha adhesive agent.

The transfer sheet bundle cooled down below the predetermined temperature is ejected out from the feed path 2604 to a bundling tray 2701.

When a sensor 2601 mounted near the outlet of the binding unit 2503 detects the back end of a bound bundle, the retracted heating unit 2505 returns to its home position to prepare the next binding.

When it is detected that a bound bundle was ejected from the binding unit 2503, the bin 2301 set at the ejection position is shifted up by the lead cam 2309, and the bin 2302 storing transfer sheets for a second bundle is coupled to the feed path 2104. At the same time, a cover sheet is supplied from the cover sheet cassette 2401. Thereafter, in the similar manner to the case of binding the first boundle, after the cover sheet setting detection sensor 2502 detects that a cover sheet arrived at the binding unit 2503, the stapled transfer sheets for a second bundle are fed from the bin 2302 to the binding unit 2503 to bind them.

Figure 4:
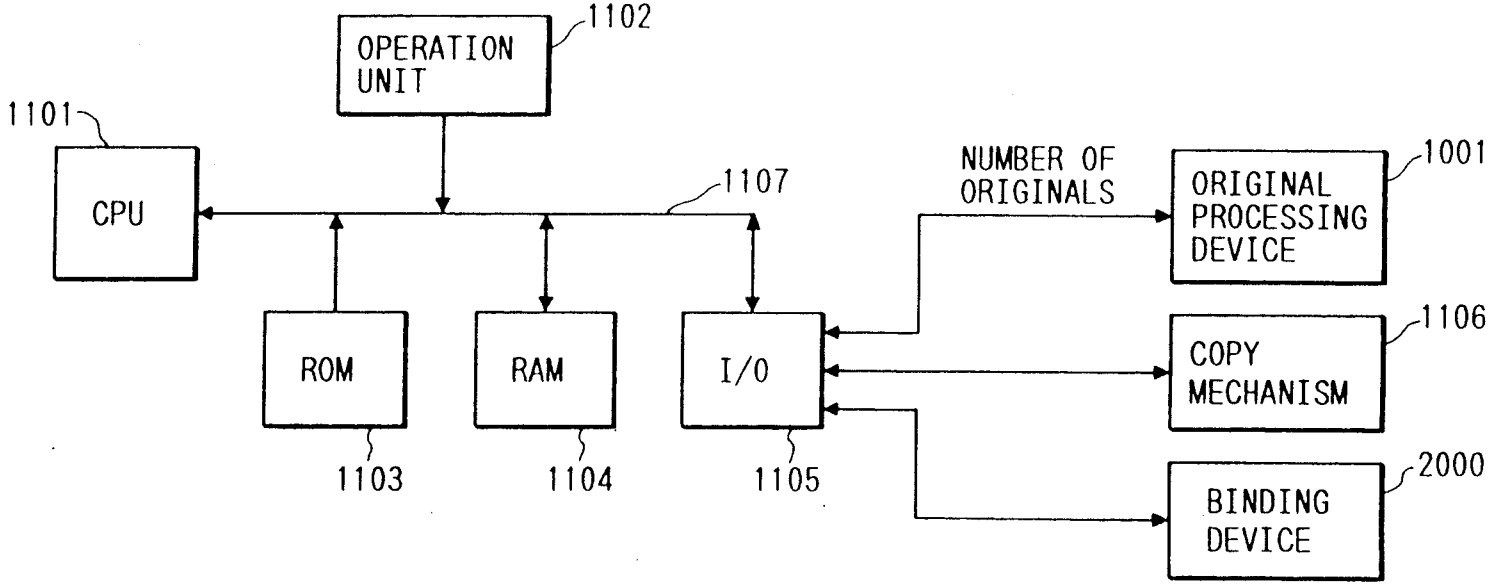
FIG. 4 is a block diagram showing the circuit arrangement of a control system of a copying machine of the embodiment of this invention.

FIG. 4 shows the circuit arrangement of the control system of the copy machine 1000 shown in FIG. 2.

In FIG. 4, connected to a common bus 1107 are a central processing unit CPU 1101, operation unit 1102, read only memory ROM 1103, random access memory RAM 1104, and input/output interface (I/O) 1105. CPU 1101 controls the operation of the copy machine. CPU 1101 executes normal copying processes and control procedures shown in FIGS. 7A and 7B to provide a binding blank space on a transfer sheet.

The operation unit 1102 has various input keys to be described later for inputting information regarding copy operations. ROM 1103 stores the control procedure to be executed by CPU 1101 and parameters used for calculation by CPU 1101. As parameters specific to this invention, blank space sizes corresponding to the numbers of originals are stored in the form of table. RAM 1104 temporarily stores data calculated by CPU 1101 and image data read from an original.

Connected to I/O 1105 are the original processing device 1001, and the copy mechanism 1106 and binding device 2000 of the copy machine. Information is transferred between these devices and CPU 1101.

Various keys mounted on the operation unit 1102 of the copy machine 1000, and their contents for instructing the copy machine 100 and binding device 2000 will be described with reference to FIGS. 5A to 5D which show front views of the operation unit.

Figure 5A:
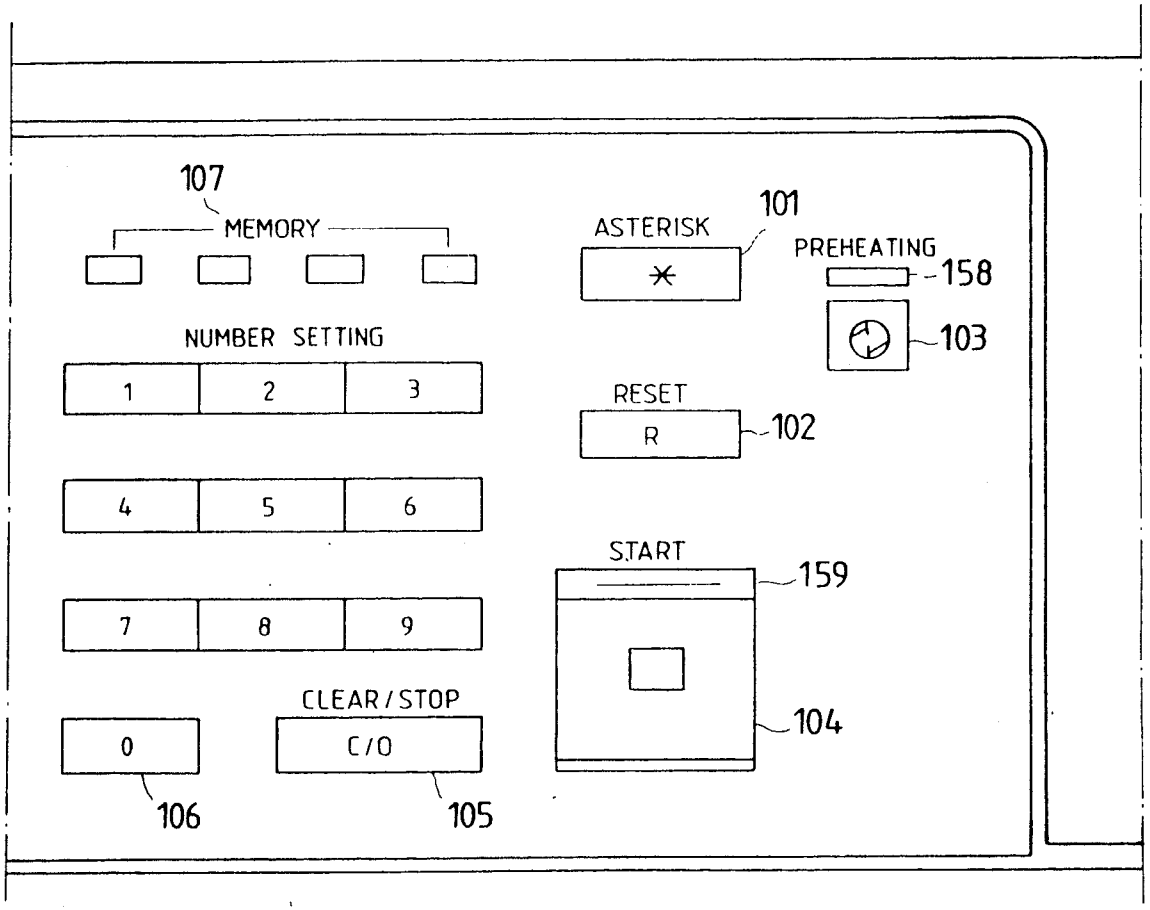
FIGS. 5A to 5D are front views showing the positions of keys on an operation unit of the embodiment of this invention.

In FIG. 5A, an asterisk (*) key 101 is used by an operator for setting various modes such as for setting a binding blank size, and setting the size of original frame erasure.

A reset key 102 is depressed when the operation mode is to be returned to a standard mode.

A preheating key 103 is depressed when the system is to be preheated or released from preheating, or when the auto shut-off state is to be returned to the standard mode.

A copy start key 104 is depressed when a copy is to be started.

A clear/stop key 105 is used as a clear key during stand-by and as a stop key during copying. The clear key is depressed when the set copy number is to be released, or when the asterisk (*) mode is to be released. The stop key is depressed when a continuous copying is to be intercepted. When a current image is completely copied after depressing the stop key, the following copy operation is stopped.

Numeric keys 106 are depressed to set the number of copies, to set the asterisk (*) mode, or to set the number of sheets used for manual binding. A memory key 107 is used for registering the mode a user frequently uses, the set mode being read and set as desired.

Figure 5B:
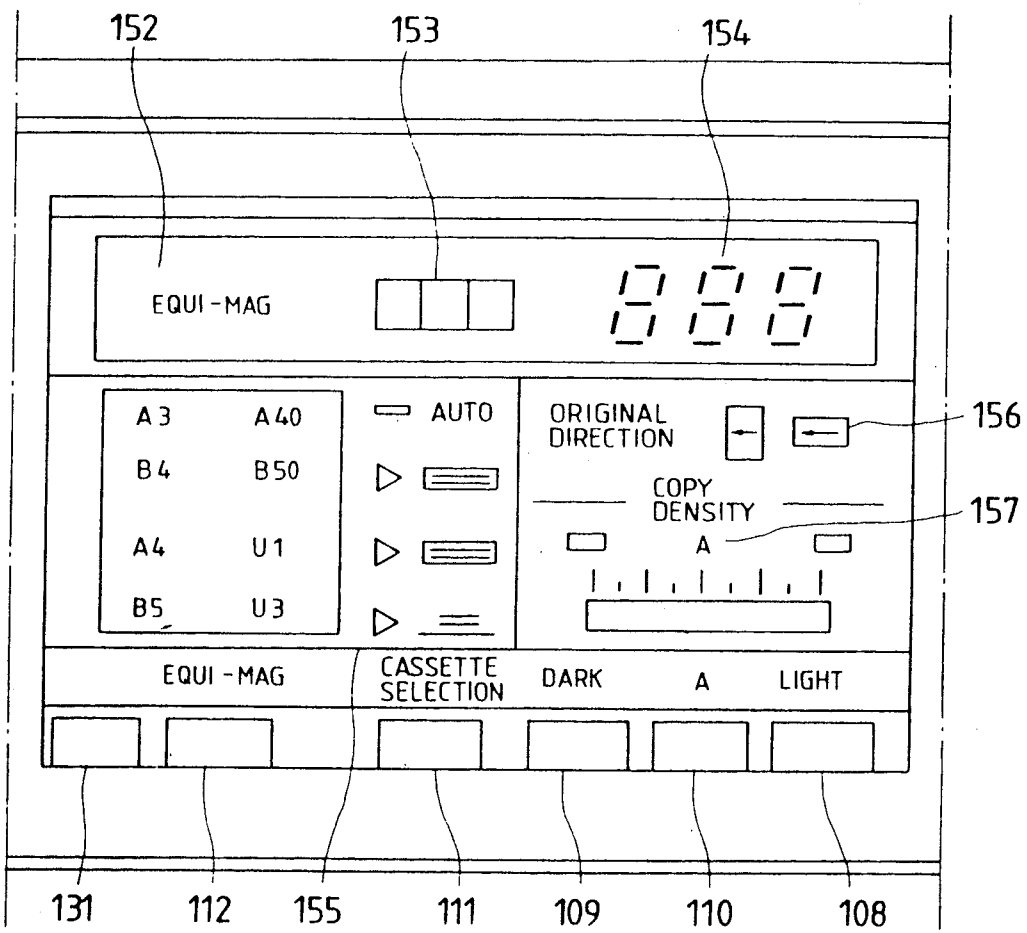

In FIG. 5B, copy density keys 108 and 109 are depressed when the copy density is to be manually adjusted. An AE key 110 is depressed when the copy density is to be automatically adjusted in accordance with the original density, or when the AE (automatic density adjustment) is to be released and switched to a manual density adjustment.

A cassette selection key 111 is depressed to select one of an upper cassette 18, a lower cassette 19, and a lower paper deck 20. When an original is set at an automatic original feeding unit 35, an APS (Automatic paper selection unit) can be selected. An equi-mag key 112 is depressed when an original is to be copied at an equi-magnification (same size).

Figure 5C:
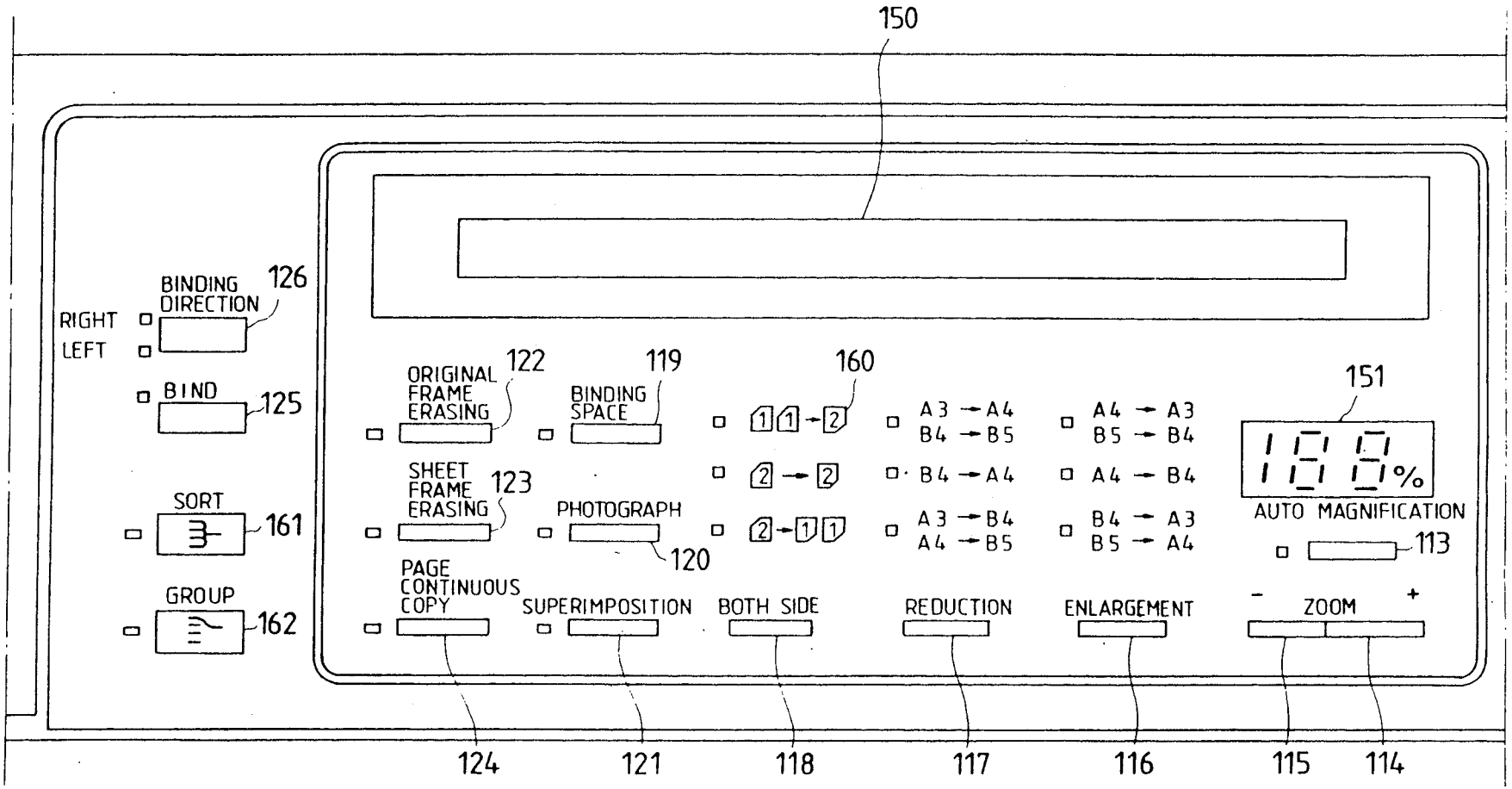

If FIG. 5C, an auto magnification key 113 is depressed to copy an original by automatically reducing or enlarging its size so as to match the size of a designated copy sheet. Zoom keys 114 and 115 are depressed to designate a desired magnification from 64 to 142%. Fixed magnification keys are depressed to designate a reduction or enlargement of a fixed size.

A both side key 118 is depressed to copy both sides of a one side original or both side original, or one side of a both side original. A binding space key 119 is depressed to provide a binding space of a designated length at the left side of a transfer sheet.

A photograph key 120 is depressed to copy a photograph original. A superimposition key 121 is depressed to copy images of two originals onto the same side of a transfer sheet.

An original frame erasing key 122 is depressed to erase a frame of a fixed size original. A sheet frame erasing key 123 is depressed to erase a frame of a sheet within a cassette.

A page continuous copy key 124 is depressed to copy the right and left original pages onto separate transfer sheets.

A both side copy display 160 is illuminated when both sides of a both side original is copied or both sides of a one side original is copied.

A binding key 125 is depressed to enter a binding mode. A binding direction selection key 126 is depressed to select a right or left binding direction.

A sort key 161 is illuminated during the standard mode when a sorter is equipped. When the sort mode is to be released or set, the sort key 161 is depressed.

A group key 162 is depressed when a plurality of copies for each original is to be obtained and stored in the same temporary storage bin. A message LCD (liquid crystal display) 150 is a semi-transmission type liquid crystal capable of displaying 40 characters each constructed of 5×7 dots, and having two backlight colors. A green backlight turns on during a normal state, and an orange backlight turns on during an abnormal state or a copy disabled state. When the cover sheet selection key 125 is depressed, the thickness of a cover sheet stored in the designated cover sheet cassette is displayed.

A magnification display 151 displays the set magnification by %.

Returning back to FIG. 5B, an equi-magnification display 152 illuminates when an equi-magnification is selected. Reference numeral 1553 represents a color development display, 154 a copy number display for displaying the number of copies or a self diagnosis code during the abnormal state.

A cassette display 155 displays which one of the upper, middle and lower cassettes is being selected. An original direction display 156 displays the original setting direction (vertical or horizontal setting). An AE display 157 turns on when the AE (automatic density adjustment) is selected.

Returning back to FIG. 5A, a preheating display 158 turns on during the preheating state, and turns off during the auto shut-off state. A ready/wait display 159 is constructed of green and orange color LEDs the former turning on during the ready state (copy enabled) and the latter turning on during the wait state (copy disabled).

Figure 5D:
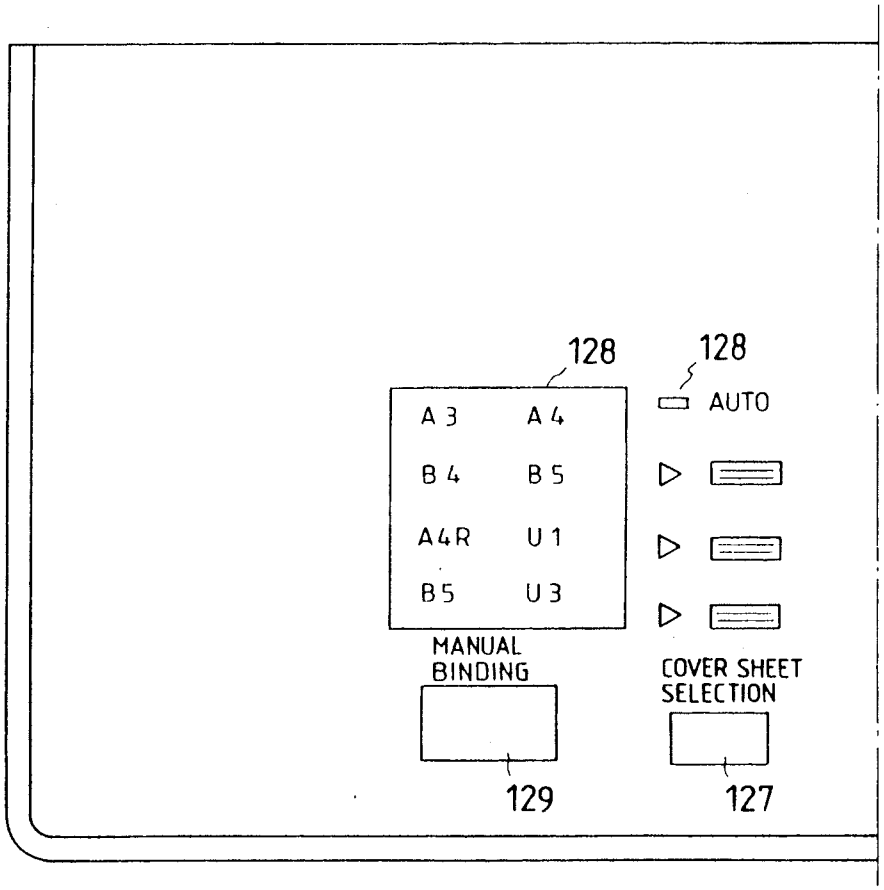

In FIG. 5D, a cover sheet selection key 127 is depressed when one of the upper cover sheet cassette 2401, middle cover sheet cassette 2402, and lower cover sheet cassette 2403 is to be selected. When the binding key 125 is depressed, an auto mode of a cover sheet cassette display 128 is generally selected. However, this does not occur if transfer sheets are put in the temporary storage bin at the later time, or if manual binding is carried out. A manual binding key 129 is depressed when manual binding is to be carried out.

Figure 6:
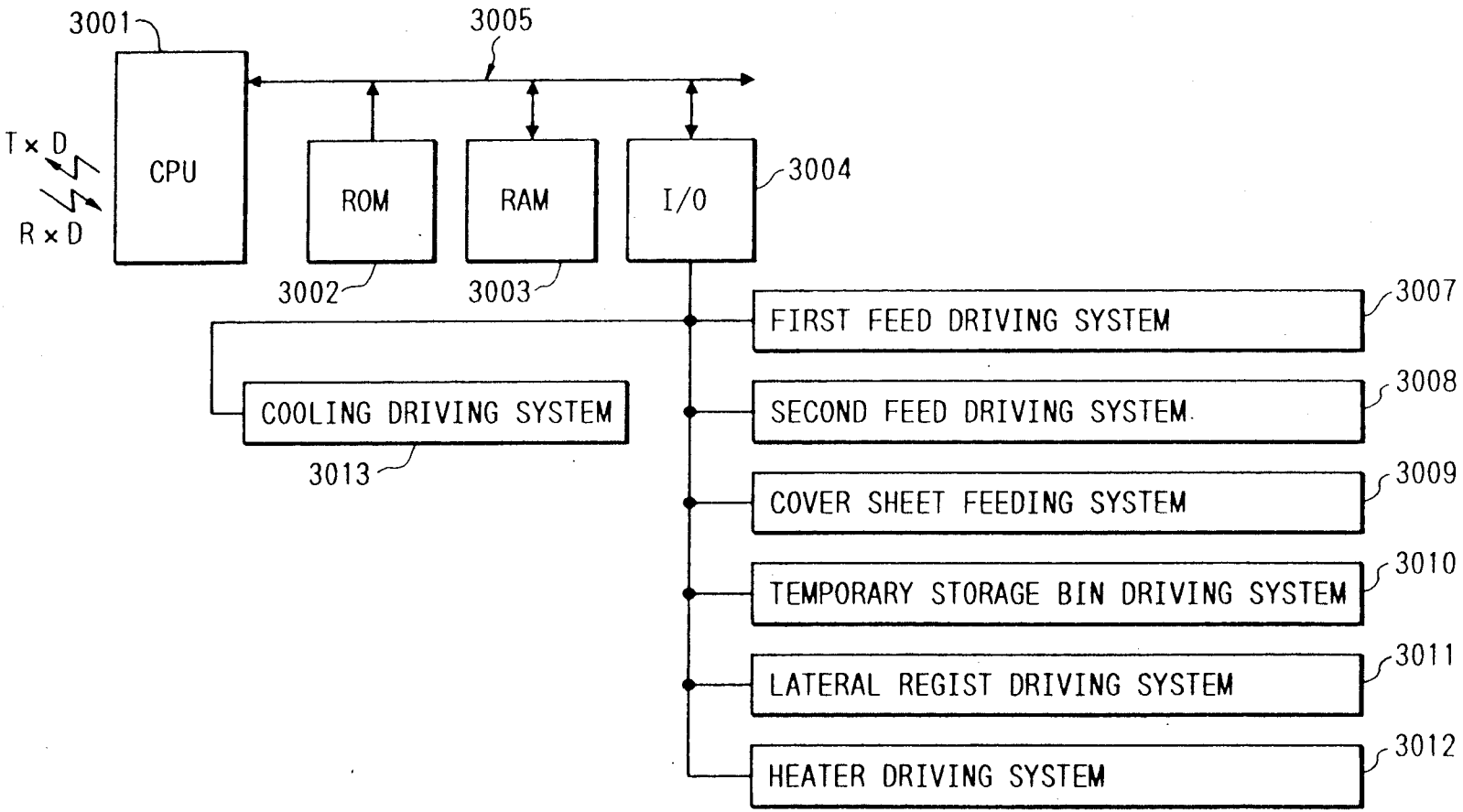
FIG. 6 is a block diagram showing the circuit arrangement of the control system of a binding machine of the embodiment of this invention.

FIG. 6 shows the circuit arrangement of the control system of the binding device 2000 shown in FIG. 2.

In FIG. 6, a central processing unit CPU executes the control procedure to be described later to control the operation of the binding device.

A read only memory ROM 3002 stores beforehand the control procedure to be executed by CPU 3001.

A random access memory RAM 3003 stores various data such as data calculated by CPU 3001, control data received from the copy machine 1000.

An input/output unit (I/O) 3004 transfers control signals and operation signals between the binding device and CPU 3001.

ROM 3002, RAM 3003 and I/O 3004 are connected in common to a data/address bus to control information transfer upon instruction from CPU 3001.

Connected to the I/O 3004 are a first feed driving system 3007, second feed driving system 3008, cover sheet feeding system 3009, temporary storage bin driving system 3010, width aligning plate driving system 3011, heater driving system 3012, and cooling driving system 3013.

The first feed driving system 3007 is constructed of the motor, flappers, driving circuits and the like for feeding a transfer sheet within the first feed unit 2100 shown in FIG. 2.

The second feed driving system 3008 is constructed of the motor, flappers, driving circuits and the like for feeding a cover sheet within the second feed unit shown in FIG. 2.

The cover sheet driving system 3009 is constructed of the motor and driving circuits for driving the mechanism for selecting a cover sheet from the cover sheet cassette shown in FIG. 2.

The temporary storage bin driving system 3011 is constructed of the motor and driving circuits for shifting the temporary storage bin 2300 shown in FIG. 2.

The width aligning driving system 3011 is constructed of the motor and driving circuits for moving the width aligning plate 2504 within the binding unit 2503 shown in FIG. 3.

The heater driving system 3012 is constructed of the heater of the heating unit 2505 of the binding unit 2503 and driving circuits for heating the heater. The cooling driving system 3013 is constructed of the cooling fan 2603 shown in FIG. 2 and its driving circuits. CPU 3001 transfers information through serial communication with CPU 1101 of the copy machine 1000.

Information inputted from the operation unit 1102 of the copy machine 1000 is transmitted in the format shown in FIG. 8. the information including transfer sheet size, copy number, manual binding mode, after-processing start of the binding device, and the like. CPU 3001 of the binding device transmits information to CPU 1101 of the copy device, the information including a stand-by state or busy state of the binding device, size of a cover sheet set at the cover sheet cassette, presence/absence of a cover sheet within the cover sheet cassette, cover sheet thickness, abnormal state such as jammed transfer sheets or cover sheets within the binding device.

The binding operation by the copy machine and binding device will be described with reference to the flow charts shown in FIGS. 7A and 7B. In the following description, it is assumed that two bundles of five originals of A4 size are bound.

Figures 1, 7A:
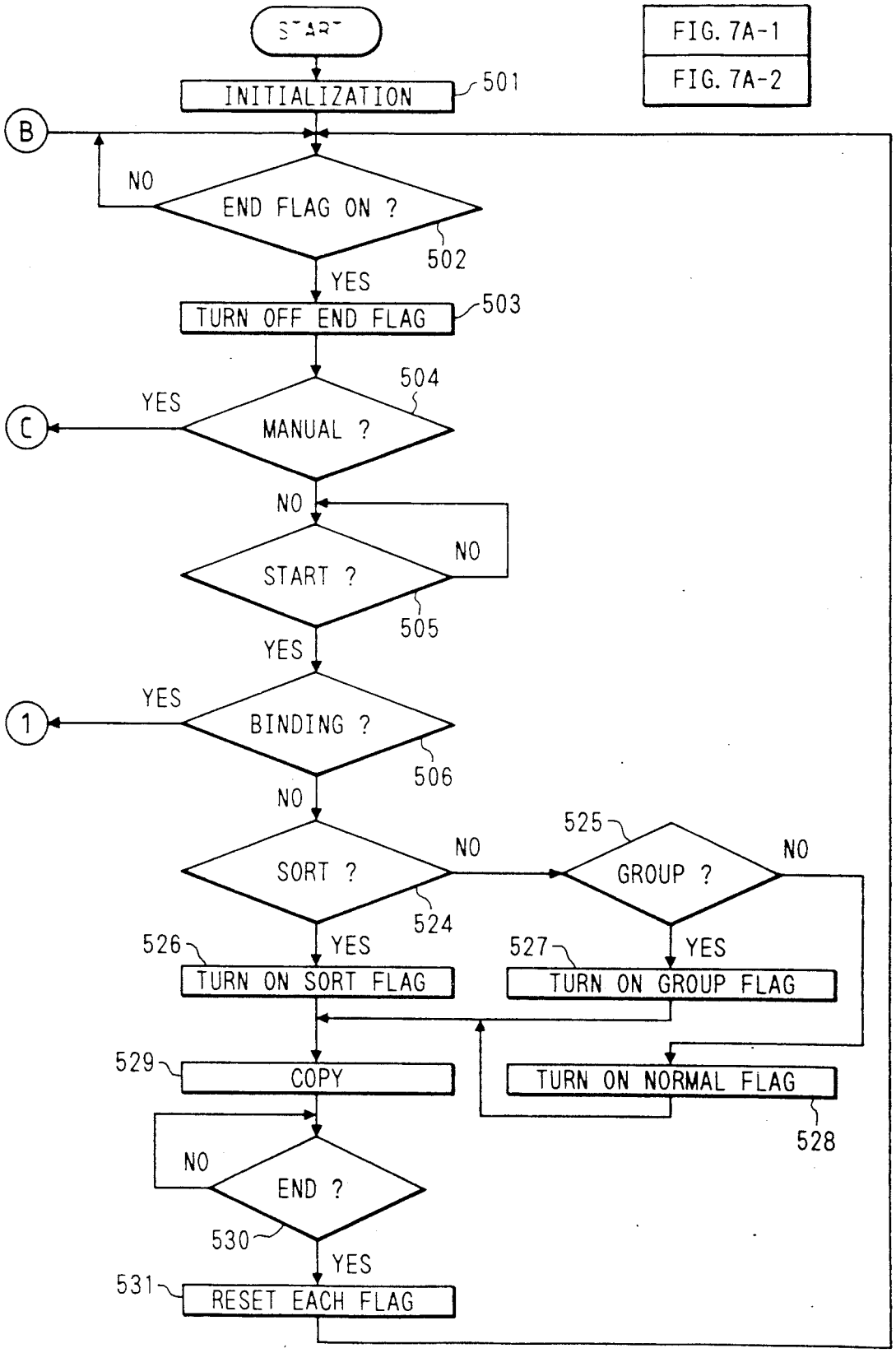
Figures 2, 7A:
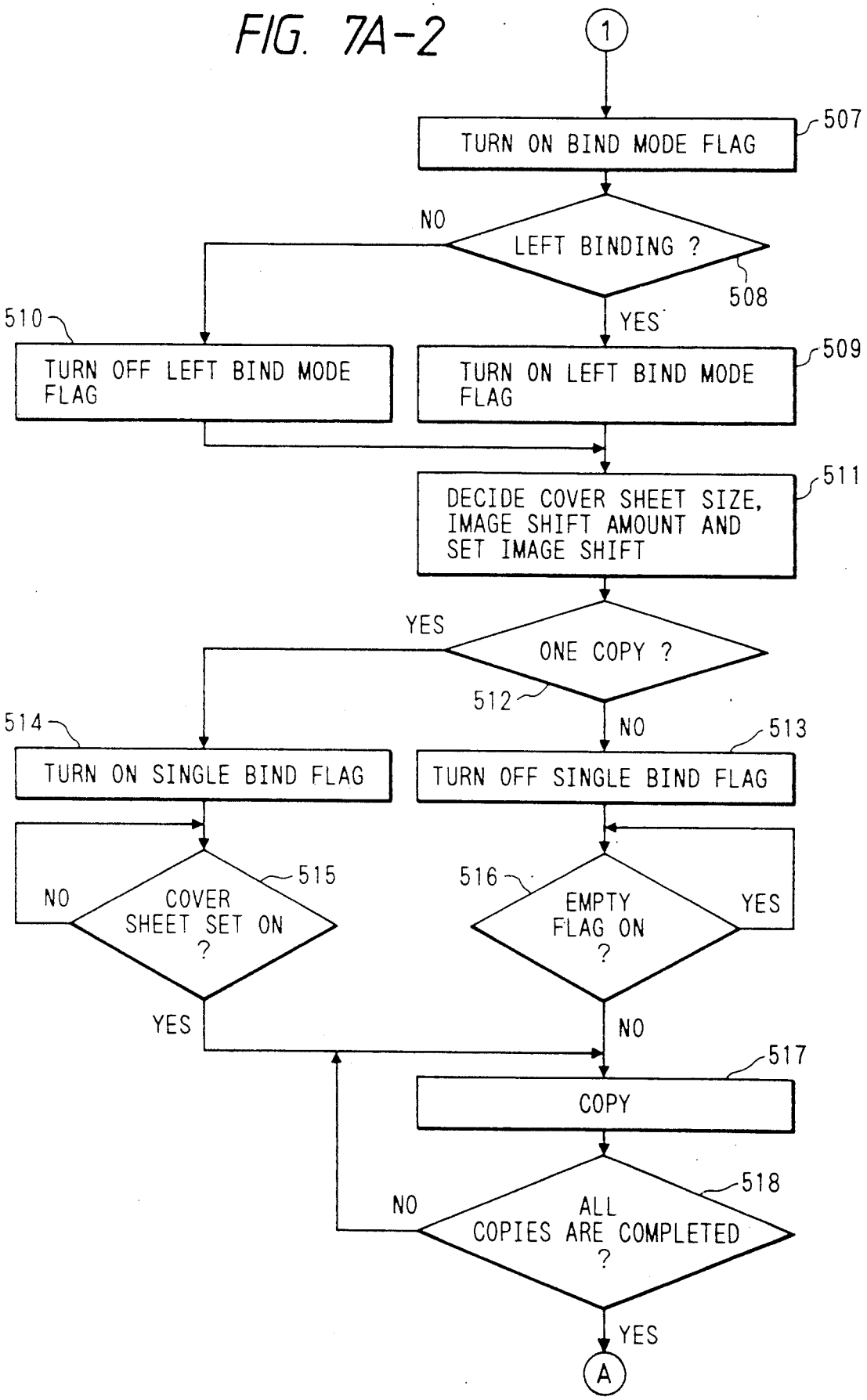
Figure 7B:
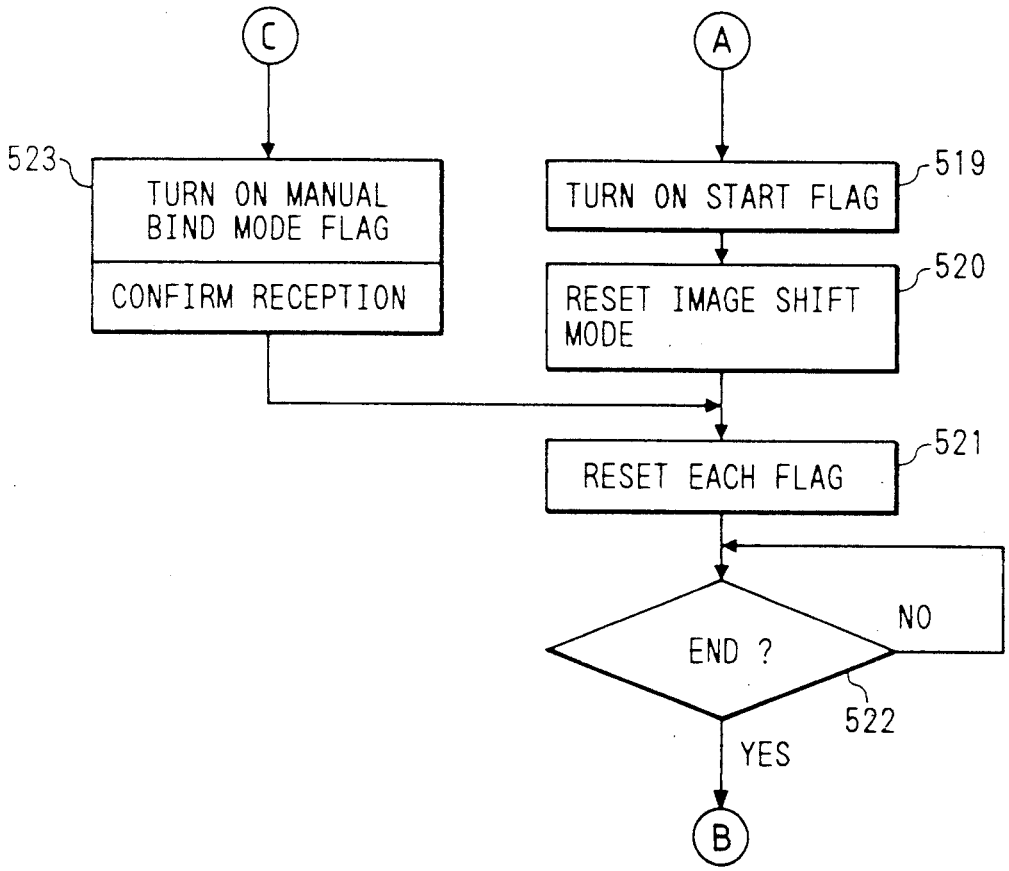

FIGS. 7A and 7B illustrate the control procedure to be executed by CPU 1101 of the copy machine.

(i-A) Binding a plurality of bundles

At the initialization step (at step 501 in FIG. 7A), it is checked if each voltage and temperature within the copy machine have reached rated values. Next, it is confirmed from an on-state of an end flag that the original processing device and binding device coupled to the copy machine are ready for the copy operation (at step 502 of FIG. 7A). The end flag indicates the copy operation status, an on-state thereof representing a copy operation and an off-state representing the completion of the copy operation. The on- and off-state of the end flag are determined in accordance with the operation information sent from the original processing device and binding device to the copy machine.

Next, at step 504 the level of the key input signal from the operation unit is discriminated to thereby judge if the manual binding mode with the manual tray opened is being designated or not. If the manual binding mode is not designated, the control advances to step 505 whereat a depression of the start key 104 is waited. When an operator depresses the binding key 125 and start key 104, the binding mode is selected and the control advances to steps 506 and 507. A binding mode flag is turned on to indicate the binding mode, this flag information being also sent to the binding device.

Next, in accordance with an instruction by the binding direction key 126 of the operation unit, the binding direction is judged if it is a right or left binding direction. If there is no such instruction, the left binding mode is automatically set. If the left binding mode is instructed, a left binding mode flag is turned on, this flag information being also sent to the binding device (at steps 508 and 509 in FIG. 7A). If the right binding direction is instructed, the left binding mode flag is turned off (at steps 508 and 510 in FIG. 7A).

Next, the original size and number information is received from the original processing device to select a cover sheet data of a cover sheet suitable for the received original size and number. The selected cover sheet data is written in the data to be transmitted. For the case of binding two bundles each having five A4 original images, there is selected a cover sheet suitable for 1 to 5 transfer sheets and having an A4 size after binding.

For detecting the number of originals by the original processing device 1001, the thickness of the originals may be automatically measured to calculate the number of originals, or the number of fed originals may be counted. The detailed description of such methods is omitted.

The blank space suitable for the original number is obtained at step 511. In this embodiment, the blank space is determined as 10 mm for 1 to 5 originals, 12 mm for 5 to 10 originals, and 14 mm for 10 to 20 originals. To provide the determined blank space on a transfer sheet, an original image shift recording mode is set. Similar to the blank space, the original image shift amount is set by CPU 1101 by deriving the data corresponding to the original number from the blank space data table stored in ROM 1103. Next, it is confirmed at step 516 from empty flag information within the information transmitted from the binding device that there is no transfer sheet in the temporary storage bin of the binding device. Thereafter, a set number of copies are obtained in the image shift mode. Namely, while forming an original image on the photosensitive drum, the turning-on timing of a drum charge erasing light emitting diode (LED) is changed with the set blank space, to thereby form a predetermined blank image on the photosensitive drum. The LED turning-on timing is controlled by counting the drive pulses of the motor which drives the photosensitive drum. For instance, to obtain a blank space for an ordinary copy operation, the LED is turned on for the time corresponding to N pulses from the start of the image, and to widen the blank, the LED is turned on for the time corresponding to N+n drive pulses. The parameter n changes with the number of originals. The timing of feeding a transfer sheet or resist timing may be changed as an alternative. A latent image formed on the photosensitive drum is developed and thereafter transferred to a transfer sheet.

If it is detected that there is a transfer sheet in the temporary storage bin, an alarm is displayed on the liquid crystal display 150 to thereby make an operator remove it.

When all copies are completed by the above-described manner, the start flag is turned on to instruct the binding device to start binding, and the flag information is written in the data to be transmitted to the binding device (at step 519 in FIG. 7B). Next, the data is transmitted to the binding device in the format as shown in FIG. 8 and, thereafter the image shift mode is canceled and each flag used in CPU 1101 is reset (at steps 520 and 521 in FIG. 7B).

The first control at the copy machine is completed in the above manner. After the end of the operation of the binding device (at step 521 in FIG. 7B), the control returns to step 502 of FIG. 7A to wait for a copy instruction of the next originals. When the start flag for the binding start is set, the binding device starts binding in accordance with the transmission data from the copy machine, and turns off the end flag. The binding operation is carried out as described above. (ii-A) Binding a single bundle In FIG. 7A, after confirming a single bundle binding mode, it is checked at the binding device if a cover sheet was set. Thereafter, the copy operation is executed (at steps 512, 514 and 515). The other processes are the same as the case of binding a plurality of bundles. (iii-A) Binding operation using manual binding tray A manual binding mode instructed from the operation unit is detected at a judgment step 504 in FIG. 7A. Then the procedure advances to step 523 of FIG. 7B whereat the manual binding mode flag in the transmission data is turned on. Transmitted from the copy machine to the binding device is the manual binding mode flag information as well as the number of originals inputted from the numerical keys 106 of the operation unit and the cover sheet data inputted from the cover sheet selection key 127. After confirming that the transmission information was received, each flag is reset to an initial condition to wait for the end of the operation by the binding device (at steps 523, 521, and 522 in FIG. 7A). (iv-A) Operation mode other than binding mode The binding device has a plurality of bins so that it can operate as a sorter. When a sorter mode is inputted from the operation unit, the control advances to steps 524 and 525 in FIG. 7A to turn on a communication sort flag and inform the binding device of the sorter mode.

If originals are to be sorted in units of group, a group flag is turned on (at steps 525 and 527 in FIG. 7A). If an ordinary sort processing is to be executed, a normal flag is turned on (at step 528). The flag information is supplied to the binding device to notify of the type of sort mode.

After executing the following operation, initialization is carried and the next copy instruction is waited (at steps 529, 530, 531, and 502).

As described so far, according to this embodiment, the size of a binding blank space on a transfer sheet is automatically set in accordance with the number of transfer sheets and hence originals. Therefore, the key operation for setting the blank space size by an operator can be simplified. The number of originals are determined manually or automatically.

According to this invention, a binding space is automatically formed when the binding mode is instructed. However, an operator may set manually the binding space as conventional by depressing the binding space key 119 and canceling the automatically set binding space.

It is possible to avoid a missing image resulting from a binding space, by reducing an image by 98% for a bundle of 1 to 5 originals, by 96% for a bundle of 5 to 10, by 94% for a bundle of 10 to 20 originals, and so on. If the number of originals is large and an image shift only does not allow a suitable binding space, the operation mode may be changed to a reduction recording mode.

As described so far, according to the present invention, the binding space is automatically changed with the number of originals. For example, if a bundle to be bound is thick, the binding space is set large. Therefore, a copied image on a bound transfer sheet has a neat appearance.

The present invention is not limited to the above embodiment, but various modifications are possible within the scope of the appended claims.

We claim:

1. An image recording apparatus comprising:

an input key for inputting a binding mode for binding a plurality of recording sheets;

an image forming unit for forming an image on said recording sheet, said image forming unit forming said image with a predetermined blank space on the recording sheet when said binding mode is inputted from said input key;

a housing unit for storing cover sheets of a plurality of sizes;

a selecting means for selecting a cover sheet from said housing unit in accordance with a number of said plurality of recording sheets;

a binding unit for binding the plurality of recording sheets ejected out from said image forming unit by adding the cover sheet selected by selecting means when said binding mode is inputted from said input key.

2. An image recording apparatus according to claim 1, further comprising an original feeding unit for sequentially feeding a plurality of originals, said image forming unit forming images of a plurality of originals fed by said original feeding unit on recording sheets.

3. An image recording apparatus according to claim 1, wherein said binding unit adheres said cover sheet to a bundle of a plurality of recording sheets.

4. An image recording apparatus according to claim 1, wherein said selecting means selects a cover sheet in accordance with a size of said plurality of recording sheets.

5. An image recording apparatus according to claim 1, wherein said image forming unit provides a binding space by changing an image forming position of a recording sheet.

6. An image recording apparatus comprising:

an image forming unit for forming an image of an original on a recording sheet; and a sheet number data outputting circuit for outputting sheet number data representative of a number of originals;

wherein said image forming unit forms an image while providing a binding space on a recording sheet, said binding space having a size corresponding to said sheet number data outputted from said sheet number data outputting circuit.

7. An image recording apparatus according to claim 6, further comprising an original feeding unit for sequentially feeding a plurality of originals, said sheet number data outputting circuit causing said original feeding unit to feed an original count the number of originals before an image is formed.

8. An image recording apparatus according to claim 6, wherein said image forming unit provides a binding space by changing an image forming position of a recording sheet.

9. An image recording apparatus according to claim 6, further comprising a binding unit for binding a plurality of recording sheets ejected out of said image forming unit.

10. An image recording apparatus comprising:

an image forming unit for forming an image of an original on a recording sheet: and a sheet number data outputting circuit for outputting a sheet number data representative of a number of originals;

wherein said image forming unit forms an image at a reduction factor corresponding to said sheet number data outputted from said sheet number data outputting circuit.

11. An image recording apparatus according to claim 10. further comprising an original feeding unit for sequentially feeding a plurality of originals. said sheet number data outputting circuit causing said original feeding unit to feed an original count the number of originals before an image is formed.

12. An image recording apparatus according to claim 10. wherein said image forming unit provides a binding space by changing a image forming position of a recording sheet.

13. An image recording apparatus according to claim 10. further comprising a binding unit for binding a plurality of recording sheets ejected out of said image forming unit.

14. An image recording apparatus according to claim 1. further comprising a second input key for inputting an instruction for providing a blank space on the recording sheet. wherein said image forming unit forms an image on the recording sheet with the blank space being provided thereon whether the instruction from said second input key is present or absent, when the binding mode is inputted from said input key.

* * * * *

UNITED STATES PATENT AND TRADEMARK OFFICE

CERTIFICATE OF CORRECTION

PATENT NO. : 5,177,548

DATED : January 5, 1993

INVENTOR(S) : NAKAMURA, ET AL.

It is certified that error appears in the above-identified patent and that said Letters Patent is hereby corrected as shown below:

On the title page:

[56] REFERENCES CITED

Insert: --Attorney, Agent or Firm - Fitzpatrick, Cella, Harper & Scinto--

[57] ABSTRACT

Line 3, "until" should read --unit--.

COLUMN 4

Line 13, "tha" should read --the--.
Line 29, "boundle" should read --bundle--.
Line 50, "of table." should read --of a table.--
Line 60, "machine 100" should read --machine 1000--.

COLUMN 6

Line 14, "numeral 1553" should read --numeral 153--.
Line 49, "control" should read --and control--.

UNITED STATES PATENT AND TRADEMARK OFFICE

CERTIFICATE OF CORRECTION

PATENT NO. : 5,177,548

DATED : January 5, 1993

INVENTOR(S) : NAKAMURA, ET AL.

It is certified that error appears in the above-identified patent and that said Letters Patent is hereby corrected as shown below:

COLUMN 9

Line 43, "carried" should read --carried out--.

COLUMN 10

Line 20, "sheets;" should read --sheets; and--.

COLUMN 12

Line 3, "a image" should read --an image--.

Signed and Sealed this

Twenty-third Day of November, 1993

Bruce Lehman

*Attest:*

BRUCE LEHMAN

*Attesting Officer*

*Commissioner of Patents and Trademarks*